US006839040B2

(12) United States Patent
Huber et al.

(10) Patent No.: US 6,839,040 B2
(45) Date of Patent: Jan. 4, 2005

(54) ANTENNA FOR A COMMUNICATION TERMINAL

(75) Inventors: Stefan Huber, München (DE); Martin Oelschläger, Berlin (DE); Michael Schreiber, Aying-Goeggenhofen (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/168,252

(22) PCT Filed: Dec. 19, 2000

(86) PCT No.: PCT/DE00/04531

§ 371 (c)(1),
(2), (4) Date: Aug. 5, 2003

(87) PCT Pub. No.: WO01/47056

PCT Pub. Date: Jun. 28, 2001

(65) Prior Publication Data

US 2004/0027295 A1 Feb. 12, 2004

(30) Foreign Application Priority Data

Dec. 20, 1999 (DE) ..... 199 61 488

(51) Int. Cl.[7] ..... H01Q 1/36
(52) U.S. Cl. ..... 343/895; 343/700 MS
(58) Field of Search ..... 343/895, 700 MS, 343/702, 745, 749, 803, 806

(56) References Cited

U.S. PATENT DOCUMENTS 5,809,433 A 9/1998 Thompson et al. ..... 455/575
5,995,064 A * 11/1999 Yanagisawa et al. ..... 343/895
6,130,651 A * 10/2000 Yanagisawa et al. ..... 343/895

FOREIGN PATENT DOCUMENTS

WO WO 98/38694 9/1998 ..... H01Q/9/04

* cited by examiner

*Primary Examiner*—Hoang V. Nguyen
(74) *Attorney, Agent, or Firm*—Bell, Boyd & Lloyd

(57) ABSTRACT

An antenna for the communication terminal having a printed conductor pattern applied to a support, wherein the printed conductor pattern includes a first printed conductor pattern section, the end of which is capacitively loaded by a second printed conductor pattern section for tuning the antenna to a desired radio channel.

15 Claims, 4 Drawing Sheets

ANTENNA FOR A COMMUNICATION TERMINAL

The present invention relates to an antenna for a communication terminal having a printed conductor pattern applied to a support, and a communication terminal including such an antenna.

BACKGROUND OF THE INVENTION

As the miniaturization of mobile communication terminals, particularly mobile telephones, increases, antennas with smaller and smaller dimensions will be needed in the future. In the field of mobile telephones, therefore, so-called "stub antennas," which only protrude out of the casing for a short distance, have mainly been used in recent times. These "stub antennas" have the disadvantage that they are mechanically sensitive and can break off. In addition, the antennas should also disappear visually as completely as possible in the miniaturized casing for design reasons. One possibility of completely integrating antennas consists in using antennas of the type mentioned initially, with a printed conductor pattern applied in or to a support; for example, so-called "PCB (printed circuit board) antennas".

Such an integrated antenna must be capable of covering the entire bandwidth of the respective radio channel. In the so-called 900-MHz GSM band, for example, transmission is in the range from 880 to 915 MHz and reception is in the range from 925 to 960 MHz so that the antenna must properly cover the range from 880 to 960 MHz. To this is added the problem, particularly in the case of mobile telephones, that the antenna resonance can shift to a different degree during the talk time which is caused by the different positions of the mobile radios in the hand of the user. This shift in the resonant frequency correspondingly must be compensated for by the antenna having an even wider bandwidth than the frequency band needed so that the entire band can be operated in even with a shift in the resonant frequency. However, wide band antennas are usually obtained if they are geometrically large, which runs counter to the aim of a miniaturized antenna. For example, an ideal antenna would have an effective length of a multiple of a quarter wavelength ($\lambda/4$) of the center frequency, of 920 MHz in the case of the 900-MHz GSM band. However, this length often cannot be achieved due to the space provided in the casing.

It is an object of the present invention, therefore, to create an antenna having a relatively wide bandwidth which can be manufactured inexpensively and reproducibly.

SUMMARY OF THE INVENTION

This object is achieved by a printed conductor pattern including a first printed conductor pattern section, the end of which is capacitively loaded by a second printed conductor pattern section for tuning the antenna to a desired radio channel.

Such capacitive loading at the end of the first printed conductor pattern section leads to an improvement in the current distribution of the antenna. The capacitive loading in this case has the effect of virtually lengthening the entire antenna so that the deviation of the effective length from the ideal length can be compensated for by the capacitive loading. This does not increase the "height" of the antenna since the phasing lines of the capacitive load extend mainly transversely to the height.

The capacitive loading thus has a similar effect to the top-loading capacitances known from the field of "normal" broadcast antenna construction, which are arranged at the top end of vertical monopole rod antennas erected on buildings, etc., but it must be considered additionally in this case that, due to the small geometric dimensions and the vicinity to the shield cover, the circuit board, the battery pack or other parts of the device, unavoidable capacitances to ground of the device occur and, in addition, the detuning by the hand of the user as mentioned occurs.

In principle, the two printed conductor pattern sections can be adapted relatively arbitrarily to the technical situations and the available spatial dimensions. However, the second printed conductor pattern section should essentially extend transversely to the first printed conductor pattern section. The first printed conductor pattern section virtually corresponds in this case to the rod antenna with a main direction of extent, which represents the vertical direction in "normal" broadcast antenna construction; the second printed conductor pattern section corresponds to the horizontal top-loading capacitance. The first printed conductor pattern section in this case preferably exhibits an elongated printed conductor which is forked at the end for forming the second printed conductor pattern section.

The second printed conductor pattern section preferably exhibits a printed conductor section extending at the end of the first printed conductor pattern section, forming a T-bar. In the simplest case, the second printed conductor pattern section only consists of this one printed conductor section so that the printed conductor pattern exhibits a simple T-shape overall. In particular, however, the second printed conductor pattern section also can be designed to be meander-shaped or meander-shaped at particular part sections in order to precisely adapt the top-loading capacitance. Various exemplary embodiments will be described in accordance with the attached drawings.

Depending on requirements, the second printed conductor pattern section can be constructed symmetrically or asymmetrically with respect to the first printed conductor pattern section. In contrast to a symmetric construction, asymmetry in the second printed conductor pattern section leads to a superposition of two waves with slightly different phase angles due to the two points of reflection at the ends of the top-loading capacitance being spaced differently from the first printed conductor pattern section. On the one hand, this leads to a reduction in the quality factor of the antenna but, on the other hand, it leads to a desirable increase in the bandwidth.

The printed conductor pattern can be designed in such a manner that the first printed conductor pattern section exhibits in the end region opposite to the second printed conductor pattern section a connecting element, such as a contact pad, via which a connection to the transceiver device of the communication terminal is effected via a contact spring. This connecting point corresponds to the base of a vertical antenna with top-loading capacitance. As an alternative, it is also possible for the first printed conductor pattern section to be capacitively loaded with a second printed conductor pattern section at both ends. In this case, the power is coupled capacitively or inductively, respectively, into the first printed conductor pattern section in the antenna.

So that the antenna can operate as a so-called "multiband antenna" in various frequency ranges, it preferably exhibits a first antenna section with a first printed conductor pattern and, in a plane which is substantially parallel to the first printed conductor pattern, a further antenna section with a further printed conductor pattern, as a result of which the antenna is tuned to a desired further radio channel; i.e., to a second resonance. In this arrangement, the further printed conductor pattern is capacitively or inductively coupled to the first printed conductor pattern. In the simplest case, the support is a circuit board which exhibits the first printed conductor pattern on one surface and a second printed conductor pattern on the opposite surface. Naturally, however, it is also possible that this is a type of multilayer circuit board which exhibits still further printed conductor patterns in the various levels as a result of which the antenna can operate not only in two areas of resonance but also in a number of areas of resonance.

In a preferred embodiment, the first printed conductor pattern section of the first printed conductor pattern exhibits the connecting element, such as the contact pad, at one end and the first printed conductor pattern section of the further printed conductor pattern is capacitively loaded by a second printed conductor pattern section at both ends. To ensure optimum bridging between the second printed conductor pattern and the first printed conductor pattern, the printed conductor patterns, and any other printed conductor pattern, are oriented in parallel with one another with respect to the main direction of extent of the respective first printed conductor pattern section; that is, the "vertical" antenna sections are in each case substantially parallel since this is the part where the bridging mainly occurs.

Additional features and advantages of the present invention are described in, and will be apparent from, the following Detailed Description of the Invention and the Figures.

DETAILED DESCRIPTION OF THE INVENTION

Since the main field of use of the antennas 10 according to the present invention is in the field of mobile telephones, wherein it offers particularly great advantages, particularly because of the problems of the antenna being covered by the hand of the user, the following exemplary embodiments are based on antennas for mobile telephones. However, it is pointed out again that, naturally, the use of such antennas is not restricted to mobile telephones.

Figure 1:
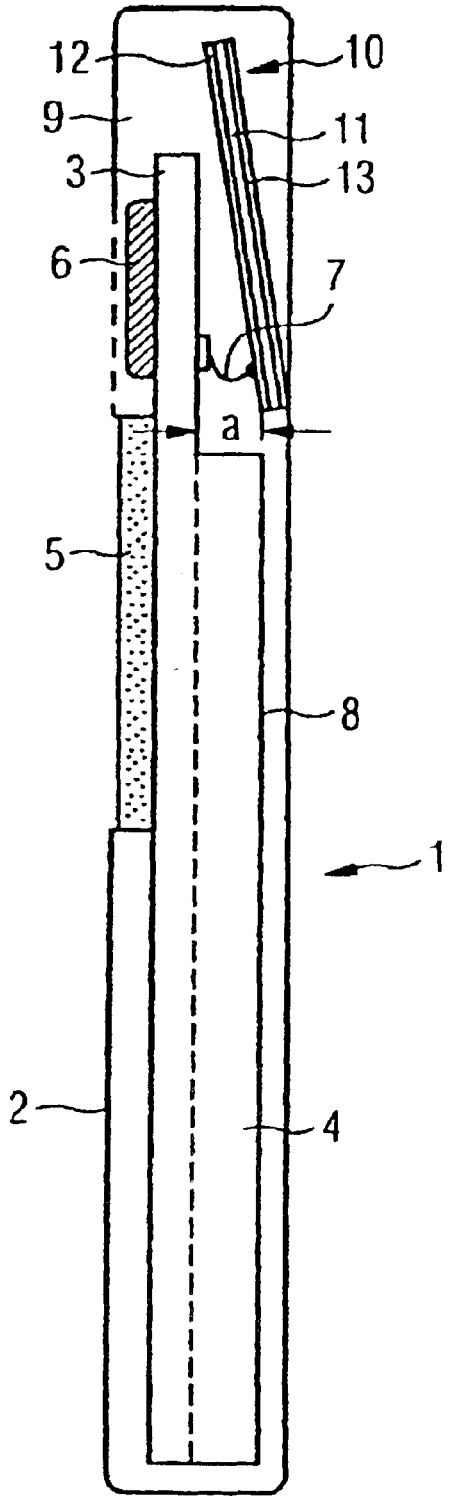
FIG. 1 shows a diagrammatic section through a mobile telephone including an integrated multiband antenna according to the present invention.

FIG. 1 shows such a typical mobile telephone 1 with a casing 2 and an integrated antenna 10 according to the present invention. The other components of the mobile telephone 1 are shown only partially and diagrammatically. On the one hand, the mobile telephone exhibits a main circuit board 3 on which the earphone capsule 6 is arranged in the upper area and below that the display 5. Below the display 5, there is the keypad (not shown). At the rear of the main circuit board 3, the battery pack 4 is arranged, among other things. The main circuit board 3 and the battery pack 4 are usually shielded by a shield cover 8 of electrically conductive material. In the upper free space of the casing behind the earphone capsule 6 between the rear of the main circuit board 3 above the battery pack 4 there is a free space 9 in which the antenna 10 is arranged.

This antenna 10 basically includes a support 11 and a first printed conductor pattern 12, located on the front of the support 11 pointing toward the main circuit board 3, and a second printed conductor pattern 13 arranged at the rear.

In a particularly simple case, which can be inexpensively produced, the antenna 10 basically including a double-sided circuit board on which the printed conductor pattern 12, 13 has been created on both sides by a conventional etching method. Naturally, the printed conductor patterns also can be printed on both sides or applied to a suitable support 11 in another suitable manner.

Figure 2A:
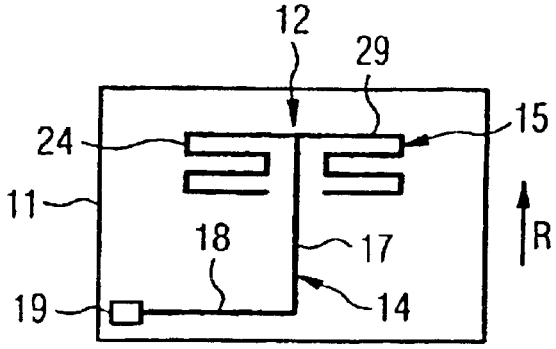
FIGS. 2*a* to 8*b*, in each case show representations of the printed conductor patterns of various exemplary embodiments of double-sided multiband antennas, with FIGS. 2*a* to 8*a* respectively showing the front with the first printed conductor pattern and FIGS. 2*b* to 8*b* respectively showing the associated back with the second printed conductor pattern.

FIG. 2*a* shows the first printed conductor pattern 12 on the front of an antenna according to a first exemplary embodiment of the present invention.

The first printed conductor pattern 12 here consists of a first printed conductor pattern section 14 which, in turn, consists of a "vertical" printed conductor section 17, which is parallel to the longitudinal axis of the mobile telephone 1, and of a "horizontal" printed conductor section 18 at the lower end.

The first "vertical" printed conductor section 17 exhibits the second printed conductor pattern section 15 as top-loading capacitance at the upper end. The second "horizontal" printed conductor section 18 of the first printed conductor pattern section 14 is used for connecting the lower end of the first printed conductor section 17 to the contact pad 19 which is arranged in the lower left-hand corner of the support 11 in the top view. The antenna 1 is connected via this contact pad 19 via a contact spring 7 to a corresponding feed line on the main circuit board 3 to a transceiver unit (not shown) (see FIG. 1). In the present exemplary embodiment, the contact spring 7 bridges a distance a of approximately 6 to 12 mm.

In all exemplary embodiments shown in the figures, the contact pad 19 is shown at the same place. However, this position is only necessitated by the construction of the respective mobile telephone 1. Naturally, the contact pad also can be arranged at any other point; for example, in the center at the bottom or in the bottom right-hand corner of the support 11.

In this arrangement, the entire first printed conductor pattern section 14 forms, starting from the output point to the transceiver unit, as so-called "base", up to the top end, a monopole antenna which virtually corresponds to the "rod antenna" known in broadcast antenna construction. At its end, this "rod antenna" is capacitively loaded by the second printed conductor pattern section 15.

To form this "top-loading capacitance" 15, the printed conductor section 17 is forked at its end; that is to say, the second printed conductor pattern section 15 exhibits a printed conductor section 29 which extends at the end of the printed conductor section 17 of the first printed conductor pattern section 14 like a T-bar.

At both ends of this printed conductor section 29 forming the T-bar, further printed conductor sections 24 extending in a meander shape, in each case, extend parallel to the main direction of extent R of the first printed conductor pattern section 14; i.e., in the direction of the printed conductor section 17. These meander-shaped printed conductor sections 24, in turn, consist of straight individual sections oriented vertically and parallel to the printed conductor section 17. In the exemplary embodiment shown, they extend from the ends of the T-bar downward; i.e., in the direction of the vertical printed conductor section 17 of the first printed conductor pattern section 14 in opposition to the main direction of extent R. Naturally, they could also extend in the direction of the main direction of extent R; i.e., toward the top. The precise shape of the meander allows, in particular, the spatial extent to be changed in relation to the antenna length and, thus, the capacitance to be set accordingly with respect to the shield cover 8 and to other components of the mobile telephone 1 in order to match the antenna to the desired resonant frequency.

The second printed conductor pattern section 15 is here designed mirror-symmetrically with respect to the first printed conductor section 17 of the first printed conductor pattern section 14.

At the rear of the support 11 there is a further antenna section with a further printed conductor pattern 13. This printed conductor pattern 13 is constructed to be very similar to the printed conductor pattern 14 at the front. The first printed conductor pattern section 20 of this second printed conductor pattern 13 corresponds here to the vertical printed conductor section 17 of the first printed conductor pattern section 14 of the printed conductor pattern 12 at the front. However, this first printed conductor pattern section 20 is provided at both ends with a further printed conductor pattern section 21 used as capacitive load which, in this case, corresponds exactly to the second printed conductor pattern section 15 at the front.

In the present exemplary embodiment, the antenna section at the front (i.e., the printed conductor pattern 12), is designed in such a manner that a resonant frequency of the antenna is within the range of the 900-MHz band of the GSM system, naturally taking into consideration the influences by the rear pattern 13. The rear pattern 13 is coupled capacitively or inductively across to the front pattern 12 and conversely. The rear structure 13 is designed in such a manner that a second resonance is located in the 1800-MHz band of the GSM system. That is to say, the entire pattern is constructed in such a manner that the next higher point of resonance having a good real component, which is usually located at a frequency of approximately 2700 MHz, corresponding to ¾ λ, is pulled down to approximately 1800 MHz. The resonance is essentially tuned precisely by the printed conductor patterns 12, 13 at the front and rear. Apart from the respective special designing of the patterns 12, 13, the thickness of the support 11, and thus the distance between the two printed conductor patterns 12, 13, and the material constants, such as the dielectric constant, of the support material naturally also have effects on the tuning of the resonance of the entire antenna 10 and must be correspondingly taken into account or suitably selected.

In particular, the widths of the printed conductors of the first printed conductor pattern section and of the capacitive loads also can be varied. The printed conductor width has a great influence on, among other things, the quality factor of the antenna and, in consequence, on the bandwidth of resonance. This also applies to simple antennas having only one antenna section.

Figure 2B:
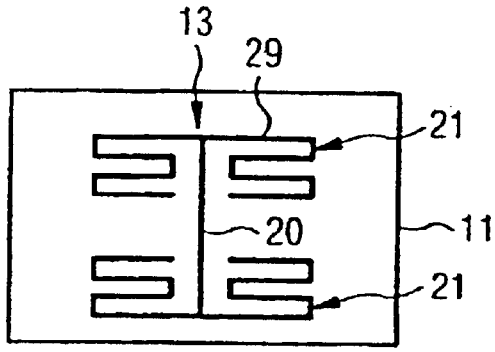
Figure 3A:
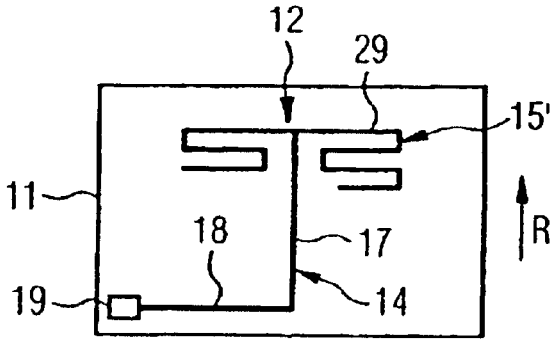
Figure 3B:
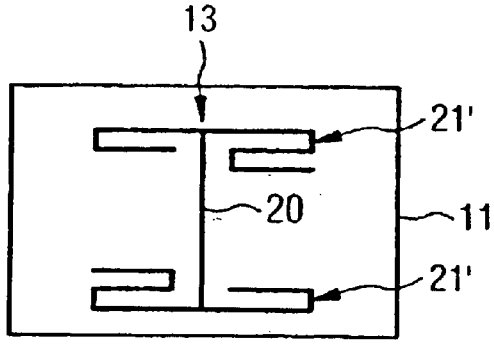

FIGS. 3*a* and 3*b* show slightly changed printed conductor patterns 12, 13 at the front and at the rear. In contrast to the antenna according to FIGS. 2*a* and 2*b*, the second printed conductor pattern sections 15', 21' forming the top-loading capacitance are not designed to be mirror-symmetric with respect to the main direction of extent R in this case. Due to the asymmetry of the two points of reflection at the ends of the printed conductor pattern sections 15', 21', a superposition of two waves with slightly different phase angles occurs. Although this reduces the quality factor of the antenna, on the one hand, it leads to a desired increase in the bandwidth, on the other hand. In the symmetric case according to FIGS. 2*a* and 2*b*, waves having the same phase angle are, in each case, created at both ends so that these ends act like a common point of resonance. The increase in bandwidth is of importance, particularly in the case of mobile telephones in which the resonance of the antenna is detuned by the hand of the user.

Figure 4A:
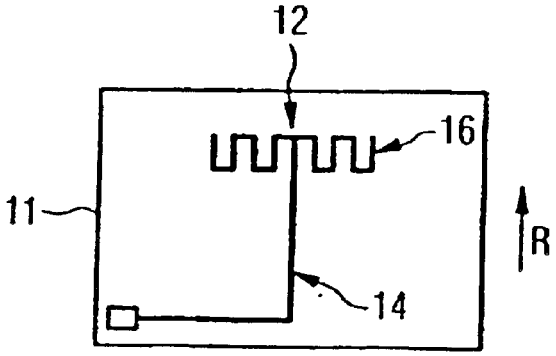
Figure 4B:
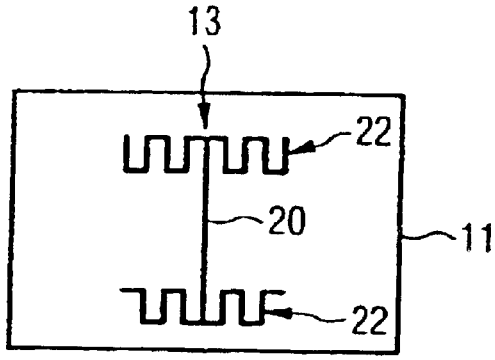

FIGS. 4*a* and 4*b* show a further exemplary embodiment of an antenna 10 according to the present invention. The first printed conductor pattern sections 14, 20 in each case correspond here to the embodiments in FIGS. 2*a* to 3*b*. However, the shape of the second printed conductor pattern sections 16, 22 is changed. The second printed conductor pattern sections 16, 22 in each case extend on both sides in a meander shape away from the end of the first printed conductor pattern section 14, 20 in a main direction of extent essentially extending transversely to the first printed conductor pattern section 14, 20. That is to say, the "T-bar" is here designed to be meander-shaped itself. This shape of the second printed conductor pattern sections 16, 22 is designed in this way both in the front printed conductor pattern 12 and in the rear printed conductor pattern 13.

Figure 5A:
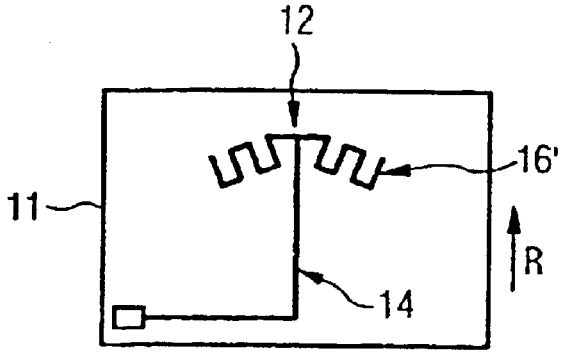
Figure 5B:
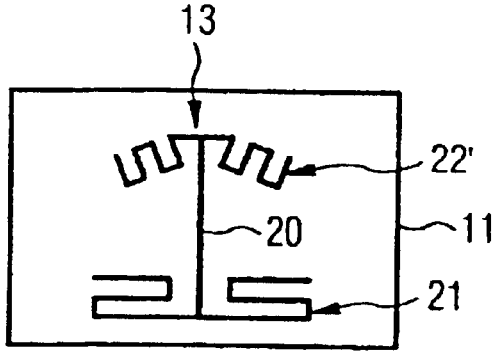

FIG. 5*a* shows the front of a further exemplary embodiment. In this case, the second printed conductor pattern section 16' is only designed to be arch-shaped at the end of the first printed conductor pattern section 14 in contrast to the shape according to FIG. 4*a*. The capacitance is, therefore, slightly increased. In addition, this exemplary embodiment shows that the antenna also can be adapted to a round casing by suitable choice of the shape of the second printed conductor pattern section 16'. For this purpose, the support 11 is correspondingly cut out. The rear printed conductor pattern 13 is again matched to the front printed conductor pattern 12 (that is to say, at the top end), the second printed conductor pattern section 22' corresponds to the second printed conductor pattern section 16' of the front printed conductor pattern 12. The lower second printed conductor pattern section 21, in contrast, is designed to be similar to the second printed conductor pattern section 21 according to the antenna according to FIG. 2*b*.

Figure 6A:
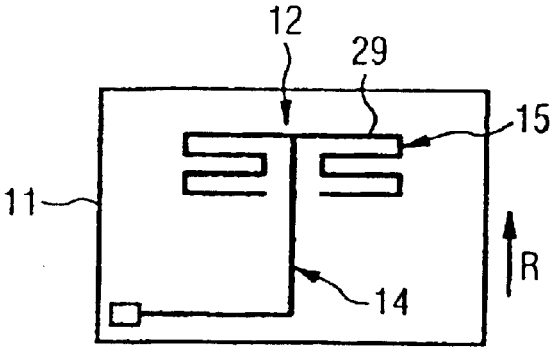
Figure 6B:
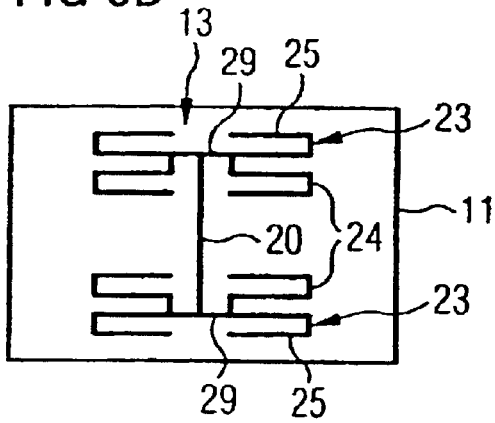
Figure 7A:
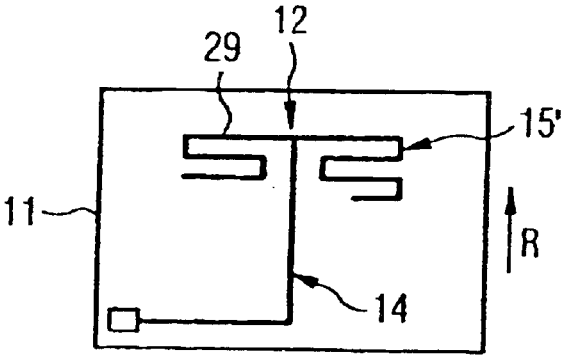
Figure 7B:
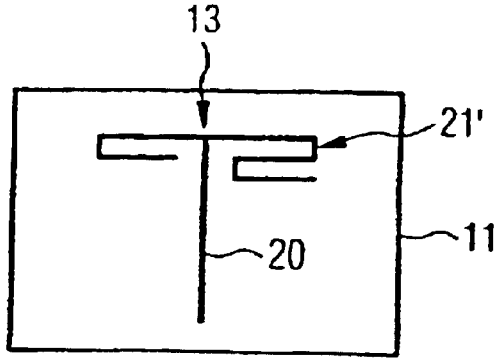
Figure 8A:
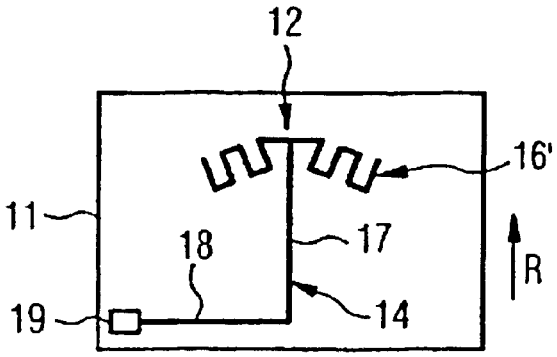
Figure 8B:
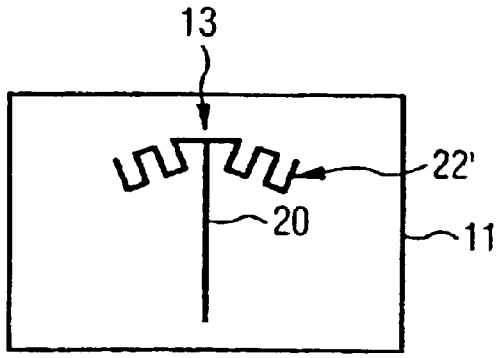

FIGS. 6*a* and 6*b* show an exemplary embodiment in which the front printed conductor pattern 12 corresponds exactly to the front printed conductor pattern 12 of the antenna according to FIG. 2*a*. In the case of the rear printed conductor pattern 20, however, the second printed conductor pattern sections 23 are, in each case, constructed in such a manner that a meander section 24 extends to the opposite end of the first printed conductor pattern section 20 and a further meander-shaped section 25 extends to the outside. This additionally increases the capacitance.

FIGS. 7*a* to 8*b* show two different exemplary embodiments of antennas in which the rear printed conductor pattern 13, in each case, exhibits a second printed conductor pattern section 21', 22' at only one end of the first printed conductor pattern section 20; that is to say, the "vertical" section of the pattern 13 is capacitively loaded at only one end. The fronts of the antennas according to FIGS. 7*a* and 8*a* correspond to the antennas according to FIGS. 3*a* and 5*a*. Such unilateral capacitive loading to the vertical element is also possible and may be appropriate under certain conditions. However, it leads to the current peak no longer being located in the center of the first printed conductor pattern section 20. To obtain good bridging to the vertical printed conductor section 17 of the first printed conductor pattern section 14 of the front printed conductor pattern 12, the embodiment with double-ended capacitive loading of the first printed conductor pattern section 20 on the rear printed conductor pattern 13 is, therefore, preferred.

Figure 9:
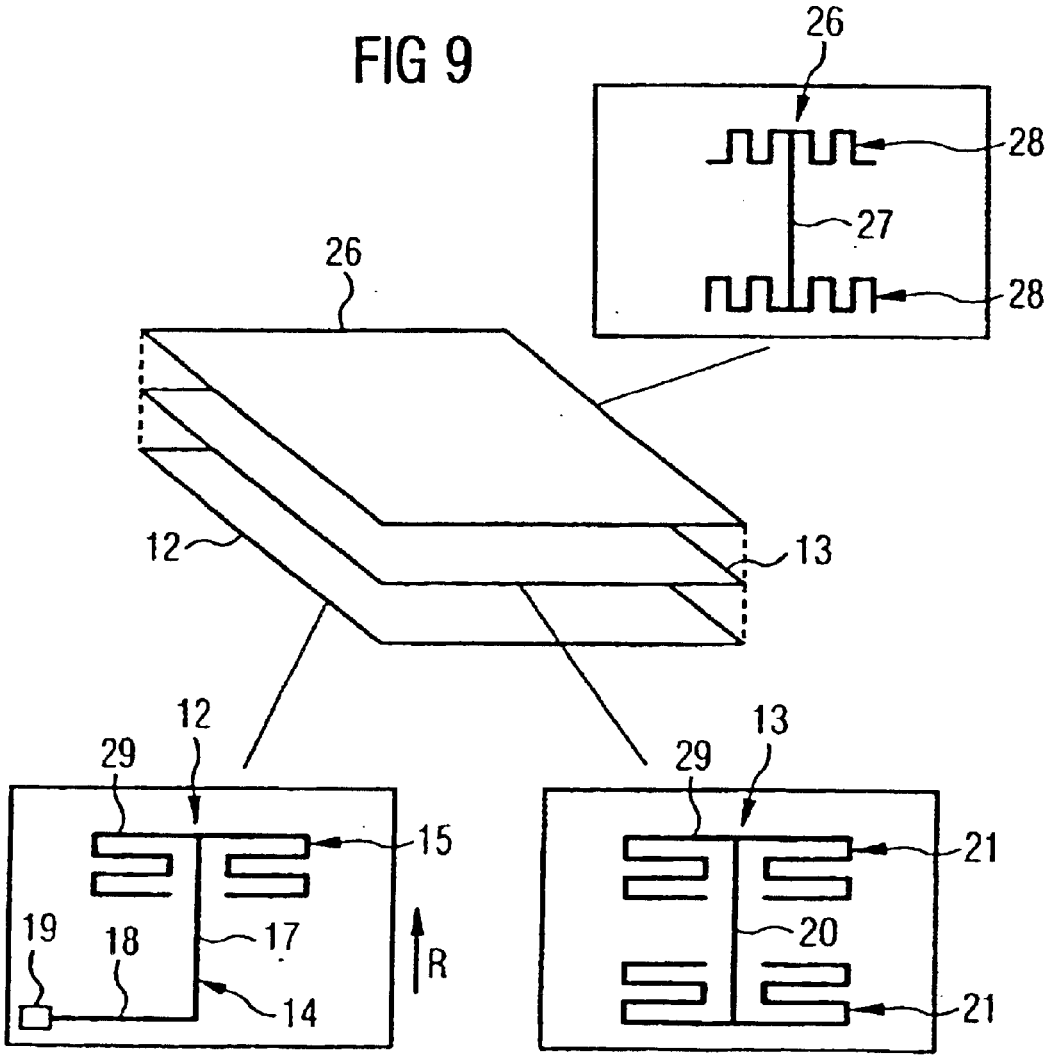
FIG. 9 shows a representation of the various patterns in various planes of an exemplary embodiment of a three-layered multiband antenna.

FIG. 9 shows a further multiband antenna which is provided for three different frequency bands. The antenna correspondingly exhibits patterns 12, 13, 26 above one another in three planes. The first printed conductor pattern 12 and the second printed conductor pattern 13 located in the center correspond, in this case, to the printed conductor patterns 12, 13 on the front and rear of the antenna according to FIGS. 2*a* and 2*b*. Above these, there is a third printed conductor pattern 26 which is constructed in accordance with the rear printed conductor pattern 20 of the antenna according to FIG. 4*b*. Naturally, the planes can be arbitrarily exchanged among themselves. In particular, the plane with the first printed conductor pattern (i.e., the plane with the contact pad), also can be in the center between the other planes. In this case, the layers of the support located above the contact pad must have corresponding recesses or the like in order to provide for a contact to the contact pad. As an alternative, the contact pad also can be plated through to the outside in a suitable manner through the planes above and below it.

As shown by the most varied exemplary embodiments, the antenna according to the present invention can be designed in the most varied shapes and is thus adaptable to the most varied casings and the available space. As a result, very small antennas with relatively wide bandwidth in a number of frequency bands can be produced extremely economically. In contrast to the helical antennas previously used for dual-band purposes, they also have the advantage in development that prototypes easily can be changed by soldering-on or removing printed conductor sections. Since the precise matching of the antenna with respect to the various resonances and the impedance depends on a great number of external parameters which cannot easily be influenced, such as on the shape of the casing, of the shield cover, of the components located on the main circuit board, etc., the optimum pattern can be calculated in advance only with extreme difficulty or not at all. As a rule, therefore, several attempts with different prototypes are required in the development of such antennas in order to find the optimum shape or pattern of the antenna for each device so that it is also possible to achieve advantages by a reduction in the development times and costs via the antennas according to the present invention.

Although the present invention has been described with reference to specific embodiments, those of skill in the art will recognize that changes may be made thereto without departing from the spirit and scope of the present invention as set forth in the hereafter appended claims.

What is claimed is:

1. A multiband antenna for a communication terminal, comprising a printed conductor pattern applied to a support, wherein the printed conductor pattern includes a first printed conductor pattern section, an end of which is capacitively loaded by a second printed conductor pattern section for tuning the antenna to a desired radio channel from multiple available channels, and wherein, for tuning the antenna to a desired further radio channel, the antenna includes a first antenna section with a first printed conductor pattern and, in a plane substantially parallel to and across from the first printed conductor pattern, a further antenna section with a further printed conductor pattern applied to the support or a further support which is at least one of capacitively coupled and inductively coupled to the first printed conductor pattern, whereby the further printed conductor pattern comprises a further first printed conductor pattern section, an end of which is capacitively loaded by a further second printed conductor pattern section for tuning the antenna to the desired radio channel.

2. An antenna for a communication terminal as claimed in claim 1, wherein the first printed conductor pattern section includes an elongated printed conductor which is forked at an end for forming the second printed conductor pattern section.

3. An antenna for a communication terminal as claimed in claim 1, wherein the second printed conductor pattern section substantially extends transversely to the first printed conductor pattern section.

4. An antenna for a communication terminal as claimed in claim 3, wherein the second printed conductor pattern section includes a printed conductor section extending at an end of the first printed conductor pattern section, forming a T-bar.

5. An antenna for a communication terminal as claimed in claim 4, wherein the second printed conductor pattern section includes further printed conductor sections extending in a meander shape in a main direction of extent oriented in parallel with the first printed conductor pattern section at both ends of the printed conductor section forming the T-bar.

6. An antenna for a communication terminal as claimed in claim 3, wherein the second printed conductor pattern section extends in a meander shape in a main direction of extent substantially extending transversely to the first printed conductor pattern section on both sides away from the end of the first printed conductor pattern section.

7. An antenna for a communication terminal as claimed in claim 1, wherein the second printed conductor pattern section is symmetric with respect to the first printed conductor pattern section.

8. An antenna for a communication terminal as claimed in claim 1, wherein the second printed conductor pattern section is asymmetric with respect to the first printed conductor pattern section.

9. An antenna for a communication terminal as claimed in claim 1, wherein the first printed conductor pattern section includes a connecting element in an end region opposite to the second printed conductor pattern section.

10. An antenna for a communication terminal as claimed in claim 9, wherein the first printed conductor pattern segment includes first and second printed conductor pattern segments, the first printed conductor pattern segment being capacitively loaded at one end by the second printed conductor pattern segment and the second printed conductor pattern segment connecting the other end of the first printed conductor pattern segment to the connecting element.

11. An antenna for a communication terminal as claimed in claim 1, wherein the first printed conductor pattern section is capacitively loaded at both ends by a second printed conductor pattern section.

12. An antenna for a communication terminal as claimed in claim 1, wherein the first printed conductor pattern section of the first printed conductor pattern includes a connecting element at one end and the further first printed conductor pattern section of the further printed conductor pattern includes the further second printed conductor pattern section as capacitive load at both ends.

13. An antenna for a communication terminal as claimed in claim 1, wherein the first printed conductor pattern and the further printed conductor pattern are substantially oriented in parallel with one another with respect to their respective first printed conductor pattern section.

14. A communication terminal comprising an multiband antenna having a printed conductor pattern applied to a support member, wherein the printed conductor pattern includes a first printed conductor pattern section, an end of which is capacitively loaded by a second printed conductor pattern section for tuning the antenna to a desired radio channel, and wherein, for purposes of tuning to a desired further radio channel, the antenna further including a first antenna section with a first printed conductor pattern and, in a plan substantially parallel to and across from the first printed conductor pattern, a further antenna section, with a further printed conductor pattern which is at least one of capacitively coupled and inductively coupled to the first printed conductor pattern.

15. A communication terminal as claimed in claim 14, wherein the communication terminal is a mobile telephone.

* * * * *